US011192006B2

(12) United States Patent
Takeuchi

(10) Patent No.: US 11,192,006 B2
(45) **Date of Patent: *Dec. 7, 2021**

(54) GOLF CLUB AND WEIGHT MEMBER FOR GOLF CLUB

(71) Applicant: SUMITOMO RUBBER INDUSTRIES, LTD., Hyogo (JP)

(72) Inventor: Hiroyuki Takeuchi, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/845,598

(22) Filed: Apr. 10, 2020

(65) Prior Publication Data

US 2020/0338408 A1 Oct. 29, 2020

(30) Foreign Application Priority Data

Apr. 26, 2019 (JP) ..... JP2019-085019

(51) Int. Cl.
*A63B 53/14* (2015.01)
*A63B 53/08* (2015.01)
(Continued)

(52) U.S. Cl.
CPC ..... *A63B 53/08* (2013.01); *A63B 53/14* (2013.01); *A63B 60/14* (2015.10); *A63B 60/16* (2015.10);
(Continued)

(58) Field of Classification Search
CPC ..... A63B 53/08; A63B 53/14; A63B 60/14; A63B 60/16; A63B 53/0487; A63B 60/54;
(Continued)

(56) References Cited

U.S. PATENT DOCUMENTS 3,625,513 A * 12/1971 Ballmer ..... A63B 60/16 473/310
5,686,158 A * 11/1997 Gibbon ..... A63B 53/14 428/36.92
(Continued)

FOREIGN PATENT DOCUMENTS

JP 2006025935 A * 2/2006
JP 4693133 B1 6/2011
(Continued)

*Primary Examiner* — Stephen L Blau
(74) *Attorney, Agent, or Firm* — Greenblum & Bernstein, P.L.C.

(57) ABSTRACT

A golf club includes a tubular club shaft having first and second ends, a weight member, and a grip attached to the club shaft. The weight member includes a weight main body made of metal and a cover formed by rubbery elastomer. The weight main body includes a first end face, a second end face, and an outer side face extending between the first and second end faces. The cover includes a side cover portion covering an entire region of the outer side face of the weight main body, a first end cover portion covering the first end face, and a flange. The weight member is installed to the club shaft in such a manner that the side cover portion is located in a space of the club shaft and that the flange engages with the first end of the club shaft outwardly of the club shaft.

20 Claims, 7 Drawing Sheets

(51) Int. Cl.

| | |
|---|---|
| ***A63B 60/14*** | (2015.01) |
| ***A63B 60/16*** | (2015.01) |
| *A63B 53/04* | (2015.01) |
| *A63B 60/54* | (2015.01) |

(52) U.S. Cl.
CPC ..... *A63B 53/047* (2013.01); *A63B 53/0466* (2013.01); *A63B 53/0487* (2013.01); *A63B 60/54* (2015.10)

(58) Field of Classification Search
CPC ... A63B 53/0466; A63B 53/047; A63B 60/42; A63B 60/24; A63B 60/08; A63B 60/50; A63B 60/02
See application file for complete search history.

(56) References Cited

U.S. PATENT DOCUMENTS 5,716,289 A * 2/1998 Okoneski ..... A63B 60/24 473/297
6,007,431 A * 12/1999 Bloom, Jr. ..... A63B 53/00 473/292
7,704,161 B2 * 4/2010 Lindner ..... A63B 60/00 473/297
8,182,360 B2 * 5/2012 Cameron ..... A63B 53/007 473/297
8,216,085 B2 * 7/2012 Fujimoto ..... A63B 53/00 473/292
8,814,717 B2 * 8/2014 Yashiki ..... A63B 53/0466 473/292
9,539,481 B2 * 1/2017 Solhaug ..... A63B 60/24
2001/0005696 A1 * 6/2001 Hedrick ..... A63B 60/00 473/318
2004/0147339 A1 * 7/2004 Lindner ..... A63B 60/24 473/316
2006/0142093 A1 * 6/2006 Moriyama ..... A63B 53/00 473/292
2011/0159982 A1 * 6/2011 Takeuchi ..... A63B 60/22 473/299
2011/0269565 A1 11/2011 Karube
2012/0165109 A1 * 6/2012 Takeuchi ..... A63B 60/42 473/297
2015/0045136 A1 * 2/2015 Boccieri ..... A63B 60/16 473/297
2015/0251062 A1 * 9/2015 Kuo ..... A63B 60/24 473/297
2015/0251064 A1 * 9/2015 Chapin ..... A63B 60/24 473/297
2018/0256953 A1 * 9/2018 Golden ..... A63B 60/24

FOREIGN PATENT DOCUMENTS

JP 2014207972 A * 11/2014
JP 5752411 B2 7/2015
WO WO 01/47611 * 5/2001

* cited by examiner

GOLF CLUB AND WEIGHT MEMBER FOR GOLF CLUB

BACKGROUND ART

Field of the Disclosure

The present disclosure relates to a golf club and a weight member for golf club.

Description of the Related Art

Golf club balance (swing weight) impacts golf swing of golfers. Golf club balance that fits golfers is different according to the ability of individual golfers. In order to adjust the club balance of a golf club, the following Patent documents 1 and 2, for example, disclose installing a metal weight member in a club shaft on the grip end side.

PATENT DOCUMENT

[Patent document 1] Japan Patent 4693133
[Patent document 2] Japan Patent 5752411

SUMMARY OF THE DISCLOSURE

When striking a ball by a golf club, or when tapping the ground by the grip of a golf club end while holding the club head, vibration occurs in the club shaft. The vibration tends to make the weight member contact with an interior surface of the club shaft and a cap closing a through hole of the grip, thus generating abnormal sound such as chattering noise.

The present disclosure has been made in view of the above circumstance, and has an object to provide a golf club and a weight member for a golf club capable of preventing generating abnormal noise as described above.

In one aspect of the disclosure, a golf club includes a tubular club shaft having a space therein and having a first end and a second end, a weight member installed on the first end side of the club shaft, and a grip attached to the club shaft on the first end side so as to cover the weight member, wherein the weight member includes a weight main body made of metal and a cover formed by rubbery elastomer for covering the weight main body, the weight main body includes a first end face located on the first end side of the club shaft, a second end face located on the second end side of the club shaft, and an outer side face extending between the first end face and the second end face in a shaft axial direction, the cover includes a side cover portion covering an entire region of the outer side face of the weight main body, a first end cover portion connected to the side cover portion and covering the first end face of the weight main body, and a flange projecting outwardly in a shaft radial direction, and the weight member is installed to the club shaft in such a manner that the side cover portion is located in the space of the club shaft and that the flange engages with the first end of the club shaft outwardly of the club shaft.

In another aspect of the disclosure, the side cover portion, in a state before being installed to the club shaft, may include an equal-diameter portion extending in the shaft axial direction with a substantially constant outer diameter, and a tapered portion located on the second end side of the club shaft with respect to the equal-diameter portion and tapering toward the second end of the club shaft.

In another aspect of the disclosure, the weight member may be provided with a through hole extending in the shaft axial direction.

In another aspect of the disclosure, the cover may further include a second end cover portion covering the second end face of the weight main body.

In another aspect of the disclosure, the rubbery elastomer may have a JIS-A hardness ranging from 50 to 70.

In another aspect of the disclosure, the flange of the cover may be sandwiched between the first end of the club shaft and the grip.

In another aspect of the disclosure, the flange may have a thickness ranging from 2 to 6 mm in the shaft axial direction.

In another aspect of the disclosure, an outer surface of the side cover portion, in a state before being installed to the club shaft, may be provided with at least one uneven element for facilitating deformation of the side cover portion.

In another aspect of the disclosure, the at least one uneven element may include one or more grooves.

In another aspect of the disclosure, the at least one uneven element may include one or more protrusions.

In another aspect of the disclosure, the at least one uneven element of the side cover portion, in a state after being installed to the club shaft, may be deformed compressingly in the space of the club shaft in contacting with an interior surface of the club shaft.

In another aspect of the disclosure, the side cover portion may have a length equal to or less than 50 mm in the shaft axial direction.

In another aspect of the disclosure, a weight member for a golf club having a tubular club shaft having a space therein and having a first end and a second end, the weight member adapted to be installed on the first end side of the club shaft, the weight member includes a weight main body made of metal, the weight main body including a first end face to be located on the first end side of the club shaft, a second end face to be located on the second end side of the club shaft, and an outer side face extending between the first end face and the second end face, and a cover formed by rubbery elastomer for covering the weight main body, the cover including a side cover portion covering an entire region of the outer side face of the weight main body, a first end cover portion connected to the side cover portion and covering the first end face of the weight main body, and a flange projecting outwardly in a radial direction of the cover with respect to the side cover portion, wherein the weight member has an outer diameter of the side cover portion capable of being arranged in the space of the club shaft, and the flange has an outer diameter capable of engaging with the first end of the club shaft outwardly of the club shaft.

DESCRIPTION OF THE PREFERRED EMBODIMENTS

Figure 1:
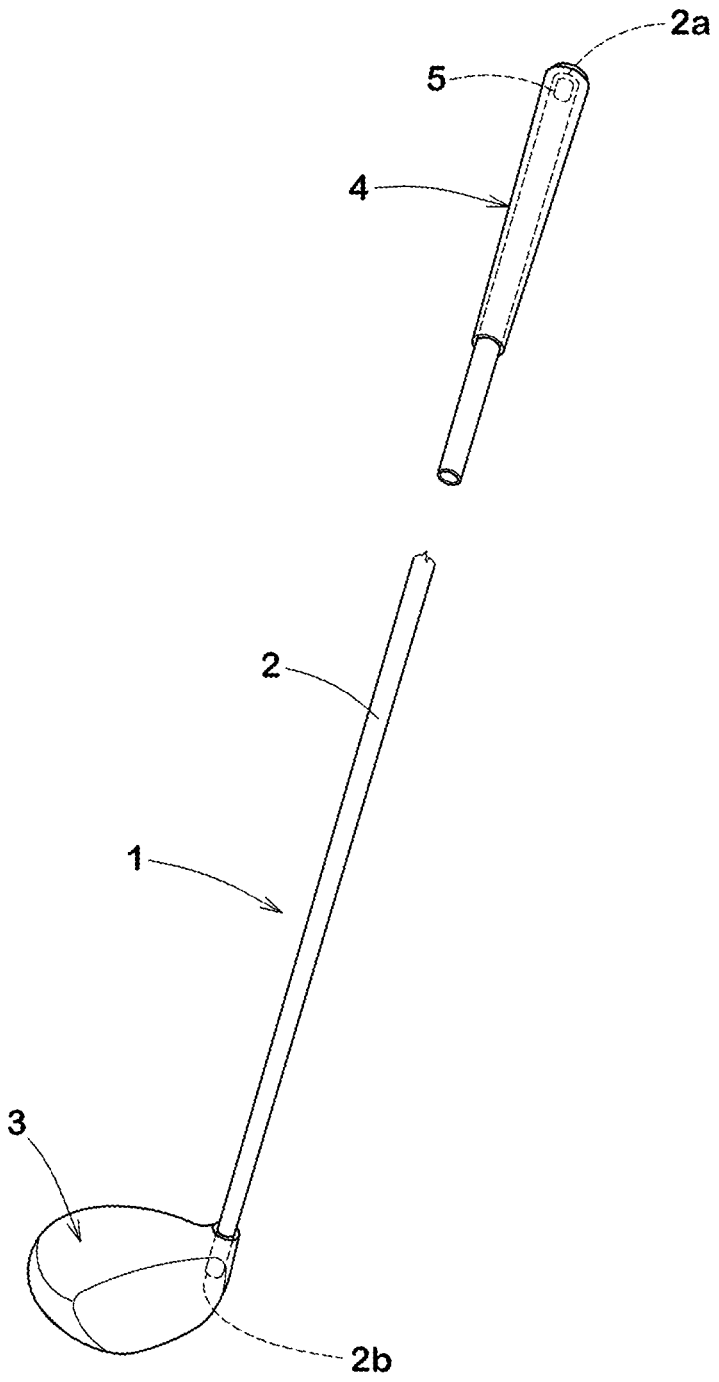
FIG. 1 is a perspective view of a golf club according to an embodiment of the disclosure.

An embodiment of the present disclosure will be explained below with reference to the accompanying drawings.

Note that the same elements or parts are denoted by the same reference numerals throughout the embodiments below, and that redundant description of already described elements is omitted.

FIG. 1 is a perspective view of a golf club 1 according to an embodiment of the disclosure. As illustrated in FIG. 1, the golf club 1 includes a club shaft 2, a golf club head 3, a grip 4, and a weight member 5.

Figure 2:
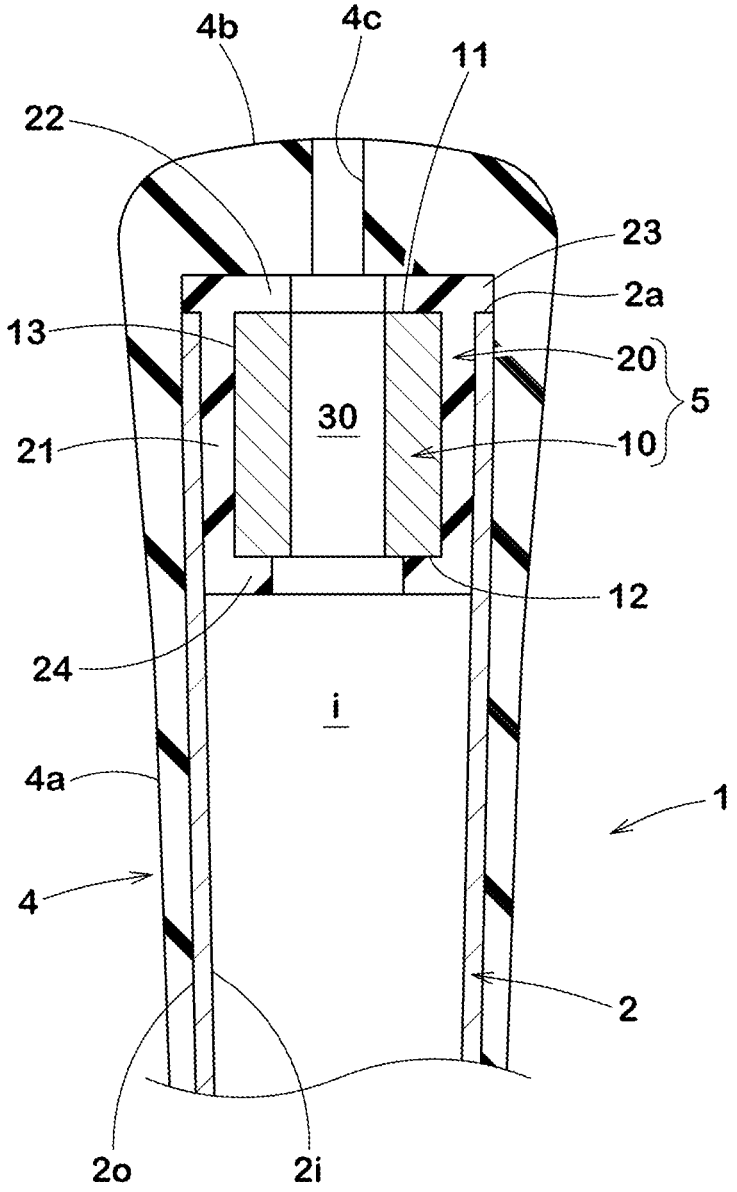
FIG. 2 is a partial cross-sectional view of the golf club on a side of the grip.

FIG. 2 is a partial cross-sectional view of the golf club 1 on the grip 4 side, wherein the cross-sectional view is a cross-section including the axial centerline of the club shaft 2. As illustrated in FIG. 1 and FIG. 2, the club shaft 2 has a tubular shape having a space (i) therein. More specifically, the club shaft 2, in a cross-section perpendicular to the shaft axial direction, has circular outer and inner circumferential faces 2*o* and 2*i*. Thus, the club shaft 2 has a cylindrical tubular shape. The club shaft 2, for example, may be configured by a fiber reinforced plastic or metallic material.

The club shaft 2, in the shaft axial direction, includes a first end 2*a* and a second end 2*b*. In the present embodiment, the club shaft 2 has a tapered shape of the outer and inner diameters both tapering gradually from the first end 2*a* toward the second end 2*b*. Note that the first end 2*a* side of the club shaft may be referred to as "butt end side" and the second end 2*b* side of the club shaft 2 may be referred to as "tip end side".

The golf club head 3, which is for striking a ball, is fixed to the second end 2*b* of the club shaft 2. The golf club head 3, for example, is configured as a wood-type head. In another aspect, the golf club head 3 may be embodied as iron-type, hybrid-type or putter-type.

The grip 4 is attached to the first end 2*a* side of the club shaft 2. The grip 4, for example, includes a tubular grip main body 4*a* that golfers grip, and a grip end face 4*b* located on a one end of the grip main body 4*a*. The grip main body 4*a* has a substantially cylindrical tubular shape, more specifically, having a tapered shape tapering according to away from the grip end face 4*b*. Additionally, another end side of the grip main body 4*a* is opened (not illustrated) so that the club shaft 2 can be inserted therefrom. Note that the grip end face 4*b* is provided with a through hole 4*c* for removing air from the interior of the golf club 1 when the club shaft 2 is inserted.

Although a material of the grip 4 is not particularly limited, a rubber is preferable, for example. As the rubber, for example, natural rubber, styrene butadiene rubber, EPDM, isoprene rubber and mixtures thereof are preferred. In view of moldability of the grip 4, EPDM and styrene butadiene rubber may further be preferred.

The weight member 5 is installed on the first end 2*a* side of the club shaft 2. Thus, the weight member 5 is located on an opposite side to the golf club head 3 in the shaft axial direction. Such a weight member 5 can be helpful to provide a counterweighted golf club 1.

The weight member 5 is configured to include a weight main body 10 made of metal and a cover 20 formed by rubbery elastomer. The weight member 5 configured as such can be molded integrally using various molding methods (an injection molding, press molding and the like), for example.

As the metallic material for the weight main body 10, it is not particularly limited. Preferably, the metallic material has a specific gravity equal to or more than 5.0, more preferably equal to or more than 7.0, still farther preferably equal to or more than 8.0 in order to obtain sufficient counterweighted balance effect with a small volume. In the present embodiment, a brass weight main body 10 is employed. Although weight of the weight main body 10 is not particularly limited, it is preferably in a range of 5 to 10 g, for example.

The weight main body 10 includes a first end face 11, a second end face 12, and an outer side face 13. In the axial direction of the club shaft 2, the first end face 11 is located on the first end 2*a* side, and the second end face 12 is located on the second end 2*b* side. In the present embodiment, both of the first end face 11 and the second end face 12 are formed in a flatted plane which is perpendicular to the shaft axial direction. Note that the first and second end faces 11 and 12 are not limited to such an aspect described above.

Figure 3:
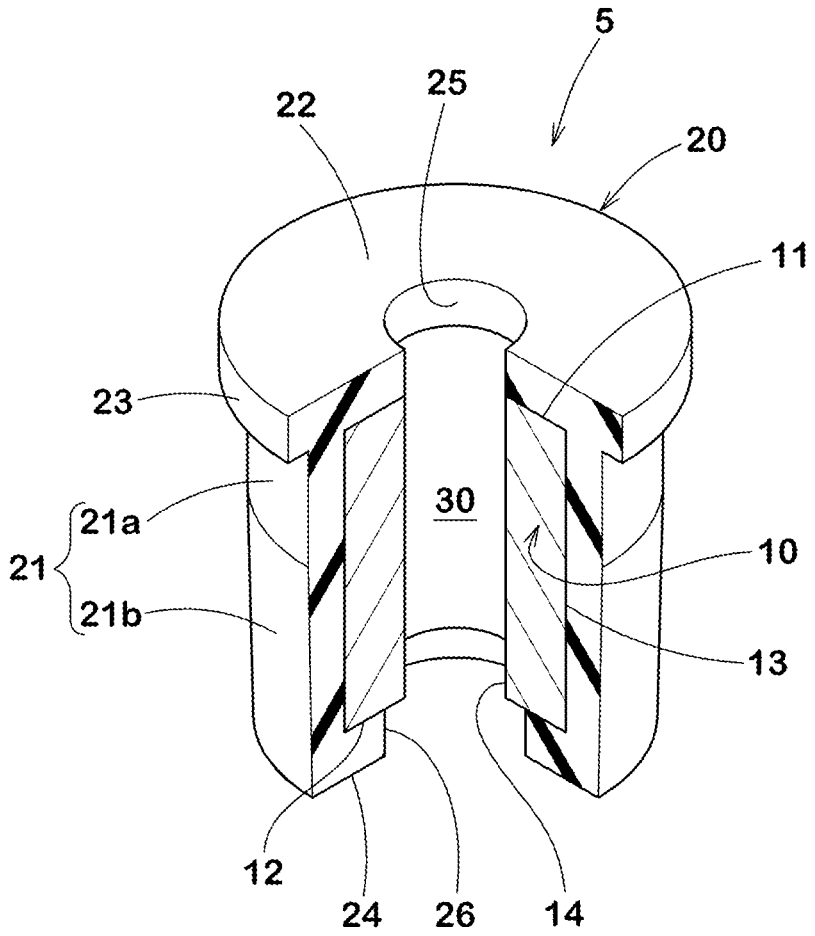
FIG. 3 is a perspective view of a weight member according to an embodiment.
Figure 4:
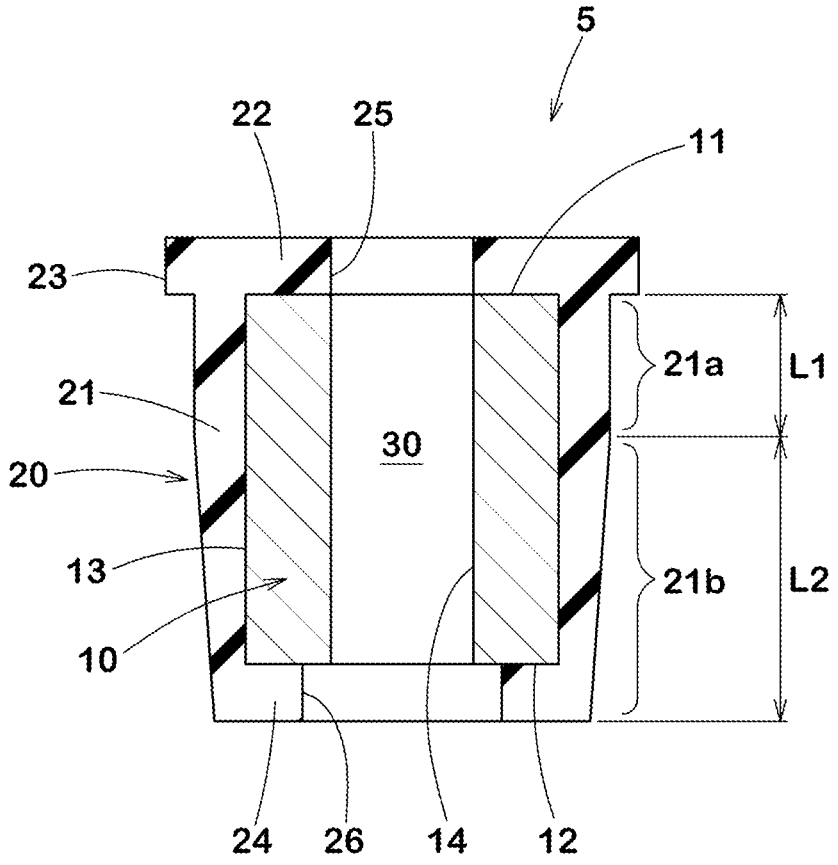
FIG. 4 is a cross-sectional view of the weight member according to the embodiment.

FIG. 3 and FIG. 4 respectively illustrate a perspective view and a cross-sectional view of the weight main body 10, in a state before being installed to the club shaft 2, according to one embodiment of the disclosure. As illustrated in FIG. 3 and FIG. 4, the outer side face 13 of the weight main body 10, for example, is a circular cylindrical surface extending in the shaft axial direction. Additionally, the weight main body 10 is provided with a central through hole 14 extending in the shaft axial direction. Thus, the weight main body 10 according to the present disclosure has a circular cylindrical shape.

The rubbery elastomer is a material which has rubber elasticity, and which includes not only vulcanized rubber but also resin material. In the present embodiment, the cover 20 is formed by vulcanized rubber.

The cover 20, for example, includes a side cover portion 21, a first end cover portion 22, and a flange 23.

The side cover portion 21 is configured so as to cover an entire region of the outer side face 13 of the weight main body 10. The side cover portion 21, for example, is configured as a cylindrical shape such which covers an entire surface of the outer side face 13 of the weight main body 10 in the shaft circumferential and axial directions.

The first end cover portion 22, for example, is connected to the side cover portion 21 to cover the first end face 11 of the weight main body 10 at least partially. In the present embodiment, the first end cover portion 22 covers an entire surface of the first end face 11 of the weight main body 10. Additionally, the first end cover portion 22 is provided with a first through hole 25 in response to the central through hole 14 of the weight main body 10. Thus, the weight member 5 is provided with a through hole 30 extending in the shaft axial direction. In the present embodiment, the first through hole 25 has an inner diameter which equals to an inner diameter of the central through hole 14 of the weight main body 10, but alternatively it may be smaller than the inner diameter of the central through hole 14.

The flange 23, for example, protrudes outwardly in the shaft radial direction on the first end cover portion 22 side. That is, an outer diameter D3 (shown in FIG. 5) of the flange 23 according to the present embodiment is configured to be greater than an outer diameter of the side cover portion 21. The flange 23 has a continuous annular body in the shaft circumferential direction.

Next, a method for installing the weight member 5 to the golf club 1 will be explained below. Firstly, the club shaft 2 to which the grip 4 is not attached is prepared. Note that the golf club head 3 may be fixed to the tip end of the club shaft 2 previously.

Next, the weight member 5 is inserted to the club shaft 2 from the first end 2*a* side. At this time, the weight member 5, as illustrated in FIG. 2, is installed in such a manner that the side cover portion 21 is located in the space (i) of the club shaft 2 and that the flange 23 engages with the first end 2*a* of the club shaft 2 outwardly of the club shaft 2. In other words, in the weight member 5, the side cover portion 21 has an outer diameter which is capable of being arranged in the space i of the club shaft 2, and the flange 23 has an outer diameter which is capable of engaging with the first end 2*a* of the club shaft 2 outwardly of the club shaft 2. Note that the side cover portion 21 may be in contact with an inner surface 2*i* of the club shaft 2, or may be separated away from the inner surface 2*i*.

Next, the first end 2*a* of the club shaft 2 is inserted to the grip 4. Thus, the weight member 5 is installed to the golf club 1.

Advantageous effect of the golf club 1 configured as such will be explained below.

Since the weight member 5 is installed on the first end 2*a* side of the club shaft 2, a counterweighted golf club 1 can be provided easily. Additionally, preparing a plurality kinds of weight members 5 which is different in weight from one another, and then by selecting one of the weight members 5 which is suitable for a specific golfer and installing it to the golf club 1, a golf club 1 with a swing weight balance optimized for the specific golfer can be produced easily.

Additionally, even after vibration occurs on the club shaft 2 due to striking a ball by the golf club 1, since the side cover portion 21 is provided, the outer side face 13 of the weight main body 10 can be avoided to contact with the inner surface 2*i* of the club shaft directly. Similarly, the first end face 11 of the weight main body 10 being made of metal can be avoided to contact directly with the grip 4 and the like with the presence of the first end cover portion 22. Accordingly, the golf club 1 according to the present embodiment can prevent generating abnormal noise such as chattering noise and the like caused by the weight member 5 even when vibration occurs on the club shaft 2 due to some factors.

Additionally, the side cover portion 21 and the first end cover portion 22 which are formed by rubbery elastomer can absorb vibration thereon even if it is generated when contacting with the club shaft 2 and/or the grip 4. Thus, the golf club 1 can provide better feeling of use.

Additionally, as illustrated in FIG. 2, the flange 23 having a large outer diameter can engage with the first end 2*a* of the club shaft 2 outside the club shaft 2, which can avoid deep entry of the weight member 5 into the club shaft 2 (hereinafter, simply referred to as "entry") during use of the golf club 1 can be avoided. This makes it possible to stabilize the location of the weight member 5, preventing unexpected change of swing weight balance.

Additionally, in the present embodiment, since the weight member 5 is provided with the through hole 30 extending in the axial direction of the club shaft 2, the weight member 5 can be inserted to the space (i) of the club shaft 2 easily while exhausting the air in the club shaft 2 in a manufacturing process of the golf club 1, improving workability.

Figure 5:
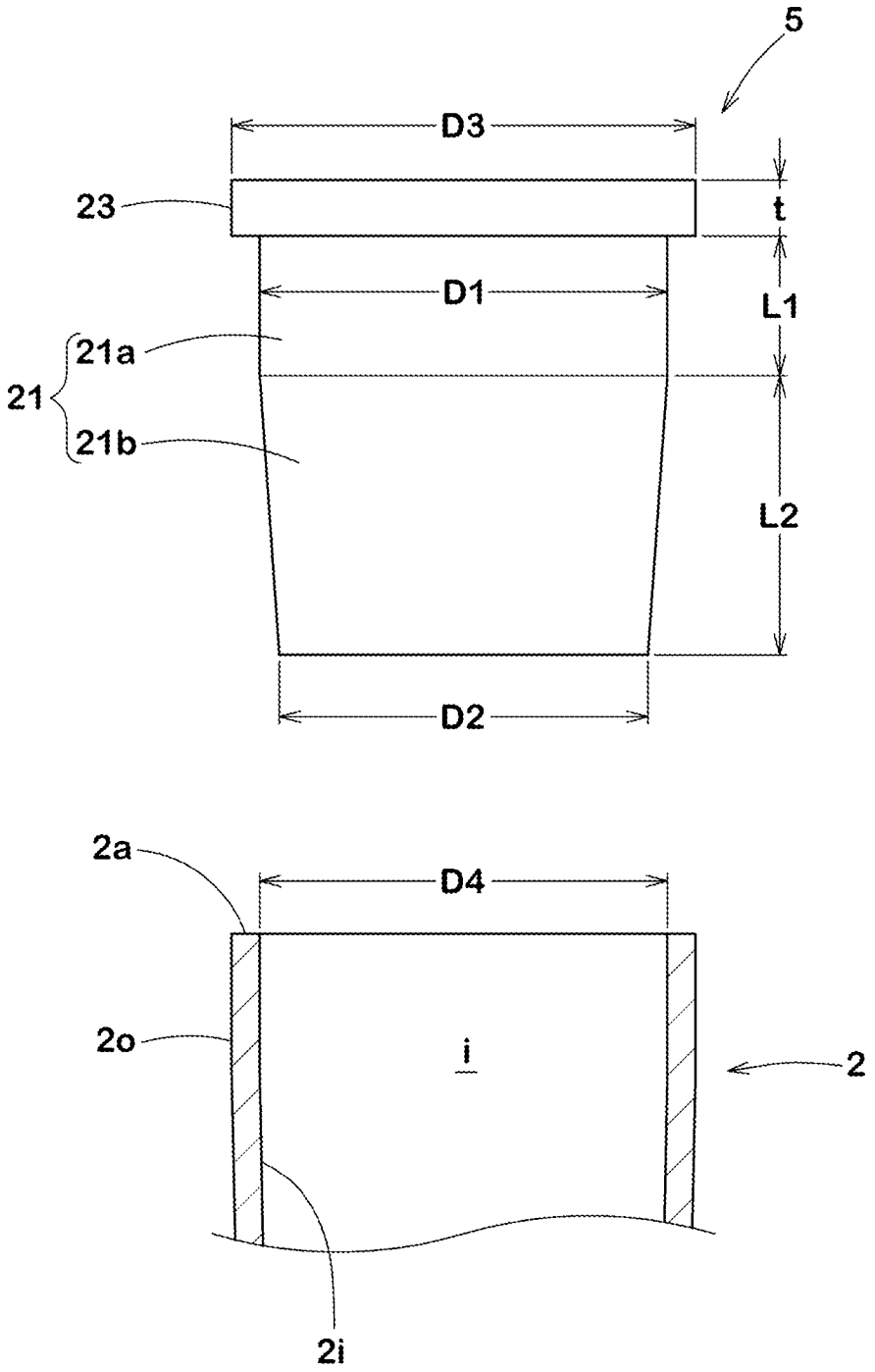
FIG. 5 is a cross-sectional view of the club shaft and a side view of the weight member which are separated from one another.

FIG. 5 illustrates a cross-sectional view of the club shaft 2, and a side view of the weight member 5 in a state before being installed to the club shaft 2. As illustrated in FIGS. 3 to 5, in some preferred embodiments, the side cover portion 21 may include an equal-diameter portion 21*a* and a tapered portion 21*h* in the state before being installed to the club shaft 2, for example.

The equal-diameter portion 21*a* extends in the shaft axial direction with a substantially constant outer diameter D1. The equal-diameter portion 21*a*, for example, extends from the flange 23 with a length L1 in the shaft axial direction. The equal-diameter portion 21*a* forms the side cover portion 21 on the butt end side in the shaft axial direction.

The tapered portion 21*b* is located on the tip end side in the shaft axial direction with respect to the equal-diameter portion 21*a* and tapered toward the tip end side in the shaft axial direction. The minimum outer diameter D2 of the tapered portion 21*b* is smaller than the outer diameter D1 of the equal-diameter portion 21*a* and the inner diameter D4 of the club shaft 2 at the first end 2*a*. The side cover portion 21 configured as such can facilitate insertion to the club shaft 2 by the tapered portion 21*b*, improving workability of installing operation.

In some preferred embodiments, a length L2 of the tapered portion 21*b* in the shaft axial direction may be greater than the length L1 of the equal-diameter portion 21*a* in the shaft axial direction, more preferably equal to or more than 1.5 times. Thus, workability of installing operation of the weight member 5 to the club shaft 2 can further be improved.

When a length of the side cover portion 21 in the shaft axial direction (i.e., L1+L2 in the present embodiment) becomes long excessively, workability of installing operation may be deteriorated, or the location of the center of gravity of the weight member 5 tends to be away from the first end 2*a* of the club shaft 2. In the above view point, the length of the side cover portion 21 in the shaft axial direction is preferably equal to or less than 50 mm, more preferably ranging from 5 to 40 mm. This makes it possible to allocate weight of the weight member 5 intensively on the first end 2*a* side of the club shaft 2.

Additionally, it is preferable that the outer diameter D1 of the equal-diameter portion 21*a* is substantially same as the inner diameter D4 of the club shaft 2 at the first end 2*a*. As used herein, the wording "substantially same" admits of having the difference between two values (e.g., between D1 and D4) in a range from −0.1 mm to 0.1 mm at least. Generally, since the inner surface 2*i* of the club shaft 2 tapers from the first end 2*a* to the second end 2*b*, the equal-diameter portion 21*a* having the outer diameter D1 and the length L1 as described above can come into contact with the inner surface 2*i* the club shaft 2. Thus, the equal-diameter portion 21*a* can be compressed at least locally.

Accordingly, the weight member 5 can be held by the inner surface 2*i* of the club shaft 2 with interfacial friction to the inner surface 2*i* of the club shaft 2 and reaction force of the cover 20 being under elastic compressive deformation. This helps to prevent the weight member 5 from moving in the shaft axial direction. Further, when the equal-diameter portion 21*a* has a certain length L1 in the shaft axial direction, the weight member 5 can closely be contact with the club shaft 2 over the shaft axial direction.

Additionally, in the above embodiment, axial force applying to the flange 23 when the golf club 1 is swung can be reduced, the entry of the weight member 5 can be avoided effectively. In order to prevent not only entry of the weight member 5 but also wobbling of the grip end, a thickness t of the flange 23 in the shaft axial direction is preferably in a range from 2 to 6 mm. Further, the flange 23, as illustrated in FIG. 2, is preferably held so as to be sandwiched between the first end 2*a* of the club shaft 2 and the grip 4. Thus, entry of the weight member into the club shaft 2 can be prevented surely.

As the cover 20 according to the present embodiment, the rubbery elastomer preferably has a JIS-A hardness ranging from 50 to 70. Having the hardness as the above range, vibration absorption property of the cover 20 can improve while maintaining sufficient strength of the flange 23 and the like. Thus, the golf club 1 can provide better feeling of use. Note that the JIS-A hardness is measured according to JIS-K 6253 under the circumstance at 23 degrees C. using a type A durometer.

As illustrated in FIG. 3 and FIG. 4, in some preferred embodiments, the cover 20 may further include a second end cover portion 24 which covers the second end face 12 of the weight main body 10. The second end cover portion 24 supports the weight main body 10 on the second end face 12 side. Thus, the second end cover portion 24 can help to prevent the weight main body 10 from dropping out to the second end 2*b* side of the club shaft 2. In this embodiment, the second end cover portion 24 is provided with a second through hole 26 which constitutes a part of the through hole 30 of the weight member 5.

[Variation 1]

Figure 6:
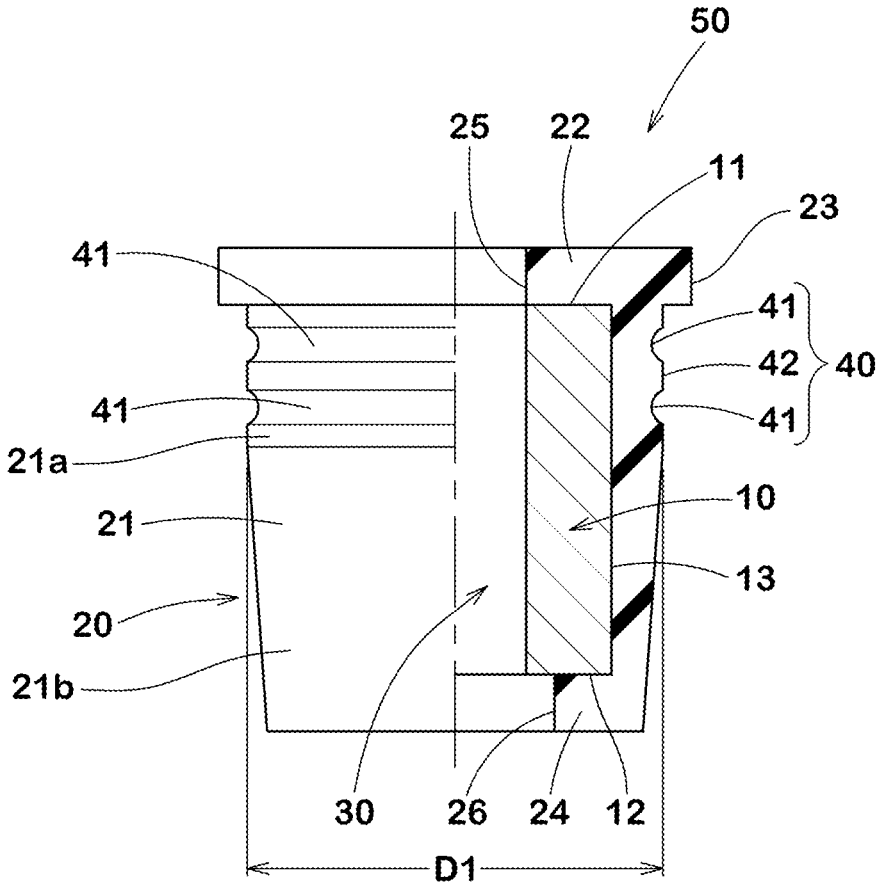
FIG. 6 is a side view (partial cross-sectional view) of the weight member according to another embodiment.

FIG. 6 illustrates a side view of the weight member 50 according to a variation 1, where the right half is illustrated as a cross section. The variation 1 differs from the side cover portion 21 of FIG. 4 in that an outer surface of the side cover portion 21, in a state before being installed to the club shaft 2, is provided with at least one uneven element 40 for facilitating deformation of the side cover portion 21. The uneven element 40, for example, is provided on the equal-diameter portion 21*a* of the side cover portion 21.

In the variation 1, the uneven element 40 includes one or more grooves 41. In FIG. 6, two grooves 41 are shown. Each groove 41, for example, extends in the shaft circumferential direction. In some preferred embodiments, the grooves 41 extend continuously in the shaft circumferential direction.

As the uneven element 40, the grooves 41 correspond to recessed parts relatively, and a non-grooved part 42 adjacent to the grooves 41 corresponds to a projected part relatively.

In the uneven element 40, a groove width and a depth of the grooves 41 are nor particularly limited. Preferably, a groove width and a depth of the grooves 41 are in a range from 0.5 to 2.0 mm, for example.

In the uneven element 40, the non-grooved part 42 has an outer diameter D1 of the equal-diameter portion 21*a*. That is, the outer diameter of the non-grooved part 42 is substantially the same as the inner diameter D4 (shown in FIG. 5) of the club shaft 2 at the first end 2*a*.

When the weight member 50 is being inserted into the club shaft 2, deformation around the uneven element 40 of the side cover portion 21 is promoted upon the side cover portion 21 is compressed by the inner surface 2*i* of the club shaft 2. For example, deformation of the cover portion 21 can be promoted in such a manner that void of the recessed portions (the grooves 41) of the uneven element 40 is reduced, which may reduce friction against the inner surface 2*i* of the club shaft 2. Accordingly, the side cover portion 21 according to the variation 1 can improve workability of installing to the club shaft 2 further. Note that a cross section of the grooves 41 and the like can be modified in various manners.

[Variation 2]

Figure 7:
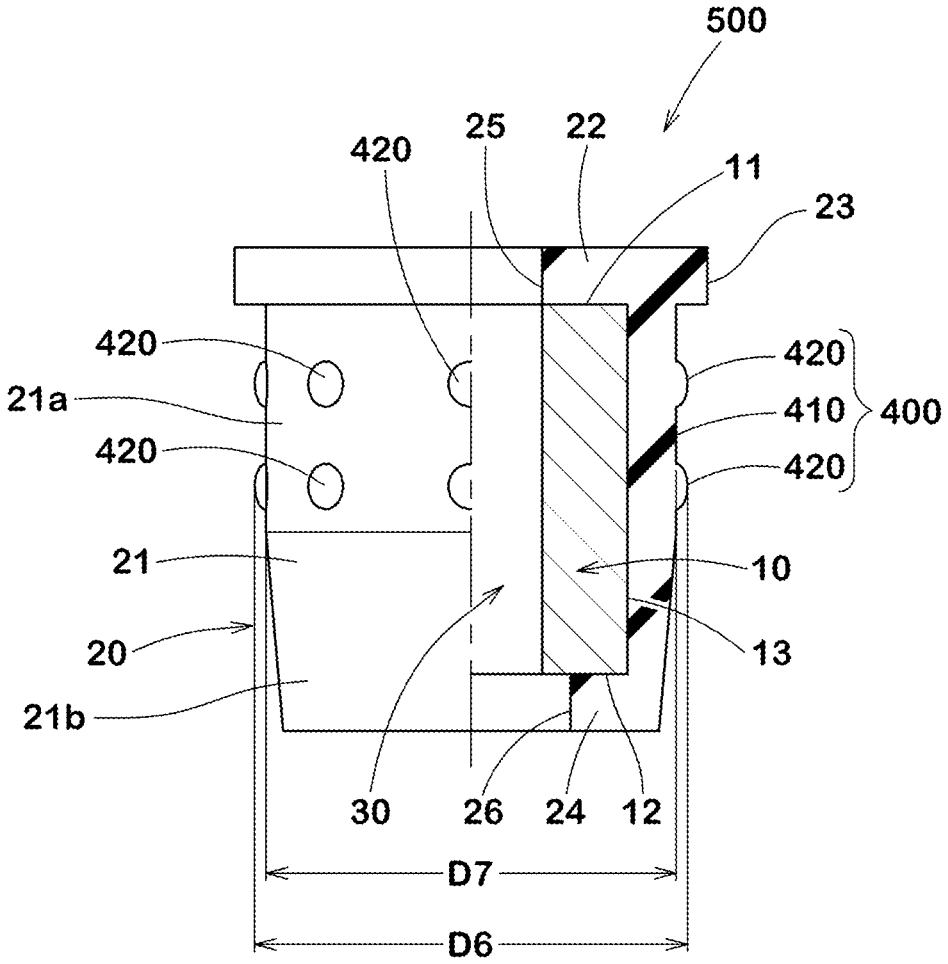
FIG. 7 is a side view (partial cross-sectional view) of the weight member according to yet another embodiment.

FIG. 7 illustrates a side view of the weight member 500 according to a variation 2, where the right half is illustrated as a cross section. In the variation 2, an outer surface of the side cover portion 21, in a state before being installed to the club shaft 2, is provided with at least one uneven element 400 for facilitating deformation of the side cover portion 21. The uneven element 400, for example, is provided on the equal-diameter portion 21*a* of the side cover portion 21.

In the variation 2, the uneven element 400 includes one or more protrusions 420. In FIG. 7, a plurality of protrusions 420 is provided around the shaft circumferential direction. In some preferred embodiments, the uneven element 400 may include one or more circumferential protrusion rows each including a plurality of protrusions 420 spaced equally in the shaft circumferential direction.

In the uneven element 400, the protrusions 420 correspond to relative projected parts, and a non-projected part 410 adjacent to the protrusions 420 correspond to a relative recessed part.

In the uneven element 400, the maximum outer diameter D6 of a location including the protrusions 420, for example, is greater than the inner diameter D4 of the club shaft 2 at the first end 2*a*, and preferably the difference between the diameters D6 and D4 is in a range from 0.2 to 0.4 mm. On the other hand, in the uneven element 400, the outer diameter D7 of the non-projected part 410, for example, is smaller than the inner diameter D4 of the club shaft 2 at the first end 2*a*, and preferably the difference between the diameters D4 and D7 is in a range from 0.2 to 0.4 mm, for example.

When the weight member 500 is being inserted into the club shaft 2, deformation around the uneven element 400 of the side cover portion 21 is promoted upon the side cover portion 21 is compressed by the inner surface 2*i* of the club shaft 2. For example, deformation of the cover portion 21 can be promoted in such a manner that void of the recessed portions (the non-projected part 410) of the uneven element 400 is reduced, which may reduce friction against the inner surface 2*i* of the club shaft 2. Accordingly, the side cover portion 21 according to the variation 2 can improve workability of installing to the club shaft 2 further. Note that a cross section of the protrusions 420 and the like can be modified in various manners such as a rectangular shape, a rib shape and the like.

While the particularly preferred embodiments in accordance with the disclosure have been described in detail above, the present disclosure is not limited to the above embodiments but can be modified and carried out in various aspects within the scope of the disclosure.

For example, in the above-embodiments, no adhesive agent is provided between a respective one of the weight members 5, 50 and 500 and the club shaft 2. Alternatively, adhesive agent may be employed therebetween.

It should be understood that the elements described in one embodiment and their variations are intended to apply (e.g., replace or add) to the corresponding elements shown in other embodiments without any explicit indication. Additionally, the variations can be implemented in combination with each other, even if there is no explicit description.

EXAMPLE

In order to confirm the effect of the disclosure, the weight members shown in FIGS. 4 to 7 were manufactured by way of trial based on specification of Table 1, and then the following tests were conducted. Additionally, as a comparative example, a metal weight member without having the cover was also prepared for the tests.

Noise Test:

While holding the golf club head of each test wood type golf club having the weight member, the grip was tapped several times on the ground. Then, chattering noise which tends to be heard like as "veen" was evaluated on a five-point scale based on the tester's feelings. The test results indicate that the larger the value, the smaller noise.

Vibration Absorption Test:

A golfer hit a golf ball using each wood-type golf club having the weight member. Then, the state of attenuation of the vibration at the time of the impact was evaluated by goiter feeling. In the evaluation, the damping characteristics were evaluated in five grades. The test results indicate that the larger the value, the higher and better the vibration absorption performance.

Entry Resistance Test:

Five test wood-type golf clubs each having the weight member were prepared for each of the examples and comparative example. Each test golf club was subjected to receive vertical vibration (up to 10000 times) with the grip up, and the grip was removed sequentially for one golf club arbitrarily selected from five every 2000 vibrations. Then, occurrence of entry of the weight member into the club shaft was visually inspected. The evaluation was based on the number of vibrations at which the entry occurred, and was evaluated on a five-point scale. The larger values indicate better resistance of entry.

The following are the common specifications of the embodiments.

Rubbery elastomer: silicone rubber

Outer diameter D1 of equal-diameter portion: 14.6 mm

Length L1 of equal-diameter portion: 5.0 mm

Outer diameter D2 of tapered portion: 14.2 mm

Length L2 of tapered portion: 10 mm

Outer diameter D3 of flange: 16.6 mm

Inner diameter D4 of club shaft: 14.7 mm

Table 1 shows the test results.

TABLE 1

| | Ref. | Ex. 1 | Ex. 2 | Ex. 3 | Ex. 4 | Ex. 5 | Ex. 6 |
|---|---|---|---|---|---|---|---|
| Cover material | — | | | silicone rubber | | | |
| JIS-A hardness of cover (deg.) | — | 52 | 52 | 71 | 84 | 52 | 52 |
| Side cover portion shape | — | FIG. 4 | FIG. 4 | FIG. 4 | FIG. 4 | FIG. 6 | FIG. 7 |
| Thickness t of flange (mm) | 1 | 1 | 3 | 2 | 1 | 3 | 3 |
| Noise test | 1 | 5 | 5 | 5 | 5 | 5 | 5 |
| Vibration absorption test | 2 | 5 | 5 | 4 | 3 | 5 | 5 |
| Entry resistance test | 5 | 2 | 5 | 4 | 4 | 5 | 5 |

From the test results, it is confirmed that golf clubs of examples show better performance in the noise test, the vibration absorption test and the entry resistance test.

What is claimed is:

1. A golf club comprising:

a tubular club shaft having a space therein and having a first end and a second end;

a weight installed on a first end side of the club shaft; and a grip attached to the club shaft on the first end side so as to cover the weight; wherein the weight comprises a weight main body made of metal and a cover formed of rubbery elastomer to cover the weight main body, the weight main body comprises a first end face located on the first end side of the club shaft, a second end face that faces toward a second end side of the club shaft, and an outer side face extending between the first end face and the second end face in a shaft axial direction, the cover comprises a side cover portion covering an entire region of the outer side face of the weight main body, a first end cover portion connected to the side cover portion and covering the first end face of the weight main body, and a flange projecting outwardly in a shaft radial direction, and the weight is installed to the club shaft in such a manner that the side cover portion is located in the space of the club shaft, the flange engages with the first end of the club shaft outwardly of the club shaft, and a bottom surface of the flange is disposed at a same level as that of a bottom surface of the first end cover portion.

2. The golf club according to claim 1, wherein the side cover portion, in a state before being installed to the club shaft, comprises an equal-diameter portion extending in the shaft axial direction with a substantially constant outer diameter, and a tapered portion extending from the equal-diameter portion and tapering toward the second end of the club shaft.

3. The golf club according to claim 2, wherein the tapered portion has a length in a shaft axial direction greater than that of the equal-diameter portion.

4. The golf club according to claim 2, wherein the equal-diameter portion is provided with one or more grooves extending in a shaft circumferential direction.

5. The golf club according to claim 4, wherein the one or more grooves extend continuously in the shaft circumferential direction.

6. The golf club according to claim 1, wherein the weight is provided with a through hole extending in the shaft axial direction.

7. The golf club according to claim 1, wherein the cover comprises a second end cover portion covering the second end face of the weight main body.

8. The golf club according to claim 1, wherein the rubbery elastomer has a JIS-A hardness ranging from 50 to 70.

9. The golf club according to claim 1, wherein the flange of the cover is sandwiched between the first end of the club shaft and the grip.

10. The golf club according to claim 1, wherein the flange has a thickness ranging from 2 to 6 mm in the shaft axial direction.

11. The golf club according to claim 1, wherein an outer surface of the side cover portion, in a state before being installed to the club shaft, is provided with at least one uneven element to facilitate deformation of the side cover portion.

12. The golf club according to claim 11, wherein the at least one uneven element comprises one or more grooves.

13. The golf club according to claim 11, wherein the at least one uneven element comprises one or more protrusions.

14. The golf club according to claim 11, wherein the at least one uneven element of the side cover portion, in a state after being installed to the club shaft, is deformed compressingly in the space of the club shaft in contacting with an interior surface of the club shaft.

15. The golf club according to claim 1, wherein the side cover portion has a length equal to or less than 50 mm in the shaft axial direction.

16. A weight for a golf club having a tubular club shaft having a space therein and having a first end and a second end, the weight configured to be installed on a first end side of the club shaft, the weight comprising:

a weight main body made of metal, the weight main body comprising a first end face to be located on the first end side of the club shaft, a second end face to face toward a second end side of the club shaft, and an outer side face extending between the first end face and the second end face; and a cover formed of rubbery elastomer to cover the weight main body, the cover comprising a side cover portion covering an entire region of the outer side face of the weight main body, a first end cover portion connected to the side cover portion and covering the first end face of the weight main body, and a flange projecting outwardly in a radial direction of the cover with respect to the side cover portion; wherein the weight has an outer diameter of the side cover portion configured to be arranged in the space of the club shaft, the flange has an outer diameter configured to be engaged with the first end of the club shaft outwardly of the club shaft, and a bottom surface of the flange is disposed at a same level as that of a bottom surface of the first end cover portion.

17. The weight according to claim 16, wherein the side cover portion comprises an equal-diameter portion extending in an axial direction of the cover with a substantially constant outer diameter, and a tapered portion extending from the equal-diameter portion and tapering toward the second end of the club shaft.

18. The weight according to claim 16, wherein the side cover portion is provided with one or more grooves extending in a circumferential direction of the cover, and the one or more grooves extend continuously in the circumferential direction of the cover.

19. A golf club comprising:

a tubular club shaft having a space therein and having a first end and a second end;

a weight installed on a first end side of the club shaft; and a grip attached to the club shaft on the first end side so as to cover the weight; wherein the weight comprises a weight main body made of metal and a cover formed of rubbery elastomer to cover the weight main body, the weight main body comprises a first end face located on the first end side of the club shaft, a second end face that faces toward a second end side of the club shaft, an outer side face extending between the first end face and the second end face in a shaft axial direction, and a through hole extending in the shaft axial direction, the cover comprises a side cover portion having a length equal to or less than 50 mm in the shaft axial direction and covering an entire region of the outer side face of the weight main body, a first end cover portion connected to the side cover portion and covering the first end face of the weight main body, a second end cover portion covering the second end face of the weight main body, and a flange projecting outwardly in a shaft radial direction, and the weight is installed to the club shaft in such a manner that the side cover portion is located in the space of the club shaft, and the flange engages with the first end of the club shaft outwardly of the club shaft.

20. A golf club comprising:

a tubular club shaft having a space therein and having a first end and a second end;

a weight installed on a first end side of the club shaft; and a grip attached to the club shaft on the first end side so as to cover the weight; wherein the weight comprises a weight main body made of metal and a cover formed of rubbery elastomer to cover the weight main body, the weight main body comprises a first end face located on the first end side of the club shaft, a second end face that faces toward a second end side of the club shaft, an outer side face extending between the first end face and the second end face in a shaft axial direction, wherein the first end face of the weight main body defines a terminal end of the weight main body on a most first end side, the cover comprises a side cover portion having a length equal to or less than 50 mm in the shaft axial direction and covering an entire region of the outer side face of the weight main body, a first end cover portion connected to the side cover portion and covering the first end face of the weight main body, and a flange projecting outwardly in a shaft radial direction, and the weight is installed to the club shaft in such a manner that the side cover portion is located in the space of the club shaft, and the flange engages with the first end of the club shaft outwardly of the club shaft.

* * * * *